US005584531A

United States Patent [19]

Bowman

[11] Patent Number: 5,584,531

[45] Date of Patent: Dec. 17, 1996

[54] FACE TO FACE PLAY AREA

[76] Inventor: Judy Bowman, 3438 Meadow Brook Ct., Napa, Calif. 94558

[21] Appl. No.: 608,621

[22] Filed: Mar. 1, 1996

[51] Int. Cl.[6] ..... A47C 15/00

[52] U.S. Cl. ..... 297/245; 297/136; 297/137; 297/157.1; 108/25; 108/26; 108/45; 446/227

[58] Field of Search ..... 297/245, 136, 297/137, 157.1, 232; 446/227; 108/24, 25, 26, 44, 45

[56] References Cited

U.S. PATENT DOCUMENTS

| | | | |
|---|---|---|---|
| 888,850 | 5/1908 | Richardson | 297/136 X |
| 1,281,104 | 10/1918 | Unger | 108/26 |
| 1,449,050 | 3/1923 | Litwin | 297/136 |
| 1,518,671 | 12/1924 | Novinsky | 297/136 X |
| 1,550,553 | 8/1925 | Macklem | 297/136 |
| 2,481,725 | 9/1949 | Culley et al. | 297/137 |
| 2,595,532 | 5/1952 | Leitner | 297/136 X |
| 2,697,478 | 12/1954 | McKinney | 297/137 X |
| 2,805,706 | 9/1957 | Landry | 297/136 X |
| 2,888,147 | 5/1959 | Goldberg | 108/25 |
| 3,454,272 | 7/1969 | Elkington et al. | 297/137 |
| 3,560,046 | 2/1971 | Brosk | 297/157.1 |
| 5,342,108 | 8/1994 | Housekeeper | 297/125 |

FOREIGN PATENT DOCUMENTS

| | | | |
|---|---|---|---|
| 2237420 | 2/1975 | France | 446/227 |
| 809343 | 7/1949 | Germany | 297/136 |

*Primary Examiner*—Peter M. Cuomo
*Assistant Examiner*—Rodney B. White

[57] ABSTRACT

A face to face play area including a base portion that has a plurality of cylindrical members. The cylindrical members are positionable adjacent a corner of the base portion. Included is a top portion that has an upper side, an underside and a pair of circular openings. The upper side has a rectangular play area that is spaced between the circular openings. The underside has a plurality of cylindrical slots, with each slot capable of receiving one of the cylindrical members of the base portion. Each circular opening forms a peripheral ledge along the underside of the top portion. Each ledge has at least four pegs projecting. Lastly, included are a pair of seat members, with each seat member has a pair of elongated straps. Each strap pair has a disc-shaped cushion positioned within. Each strap has a pair of supporting ends with a pair of keyholes. Each keyhole couples with at least one of the pegs of one of the circular openings.

9 Claims, 3 Drawing Sheets

FACE TO FACE PLAY AREA

BACKGROUND OF THE INVENTION

1. Field of the Invention

The present invention relates to a face to face play area and more particularly pertains to providing a dual seat activity table for toddlers and babies that allows them to face each other during play.

2.Description of the Prior Art

The use of an activity table is known in the prior art. More specifically, activity tables heretofore devised and utilized for the purpose of a play table for children are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,360,264 to Crane discloses a children's play table. U.S. Pat. No. 5,342,108 to Housekeeper discloses a convertible table. U.S. Pat. No. 5,255,958 to Frischmann discloses a barrier device for children. U.S. Pat. No. 4,901,998 to Griffith discloses a multi-functional activity table. U.S. Pat. No. Des. 299,600 to Mollica discloses a combined children's table and storage unit. Lastly, U.S. Pat. No. 3,963,262 to Estell discloses a toy automobile apparatus.

While these devices fulfill their respective, particular objectives and requirements, the aforementioned patents do not describe face to face play area that allows infants and toddlers to be seated in the play area, facing each other and sharing the same play area, while safely confining the infants or toddlers in one area.

In this respect, the face to face play area according to the present invention substantially departs from the conventional concepts and designs of the prior art, and in doing so provides an apparatus primarily developed for the purpose of providing a dual seat activity table for toddlers and babies that allows them to face each other during play.

Therefore, it can be appreciated that there exists a continuing need for a new and improved face to face play area which can be used for providing a dual seat activity table for toddlers and babies that allows them to face each other during play. In this regard, the present invention substantially fulfills this need.

SUMMARY OF THE INVENTION

In view of the foregoing disadvantages inherent in the known types of activity tables now present in the prior art, the present invention provides an improved face to face play area. As such, the general purpose of the present invention, which will be described subsequently in greater detail, is to provide a new and improved face to face play area and method which has all the advantages of the prior art and none of the disadvantages.

To attain this, the present invention essentially comprises a generally rectangular base portion that is positioned on a receiving surface. The base portion has a plurality of elongated cylindrical members that project upwardly. Each cylindrical member is positioned adjacent a corner of the base portion. The base portion has a length of about 5 feet and a width of about 2 ½ feet. Each cylindrical member has a diameter of about 2 inches and a projecting height of about 15 inches. A generally rectangular top portion is included. The top portion has an upper side, an underside and a pair of circular openings passing therethrough. The underside has a plurality of cylindrical slots. Each slot has a diameter of about 2 1/32 inches and the depth of about 1 inch. Each slot is adjacent a corner of the top portion. Each slot is capable of receiving one of the cylindrical members of the base portion for positioning of the top portion above the base portion in a parallel plane. Each circular opening has a diameter of about 13 inches. Each circular opening forms a peripheral ledge along the underside of the top portion. Each ledge has at least four pegs proportionally spaced therearound and projecting therefrom. Included are a pair of seat members. Each seat member has a disc-shaped cushion that is supported by a pair of elongated straps. Each pair of straps has one strap crossed over another strap with the straps stitchedly attached one to another. Each strap has a pair of supporting ends with a pair of keyholes that are proportionately spaced one from another. One of the keyholes of the keyhole pair is spaced from an edge of each supporting end. Each keyhole is capable of coupling with at least one of the pegs of one of the circular openings. Each seat member is suspended from the top portion, when at least one keyhole of each strap is coupled to one of the pegs. Each seat member is capable of supporting a toddler within, when it is suspended from the top portion. Lastly, a U-frame is coupled to the upper side of the top portion. The U-frame is proportionately spaced from each circular opening. The U-frame is capable of rotatably supporting a plurality of play objects above the top portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved face to face play area which has all of the advantages of the prior art activity tables and none of the disadvantages.

It is another object of the present invention to provide a new and improved face to face play area which may be easily and efficiently manufactured and marketed.

It is further object of the present invention to provide a new and improved face to face play area which is of durable and reliable constructions.

An even further object of the present invention is to provide a new and improved face to face play area which is susceptible of a low cost of manufacture with regard to both materials and labor, and which accordingly is then susceptible of low prices of sale to the consuming public, thereby making such face to face play area economically available to the buying public.

Still yet another object of the present invention is to provide a new and improved face to face play area which provides in the apparatuses and methods of the prior art some of the advantages thereof, while simultaneously overcoming some of the disadvantages normally associated therewith.

Even still another object of the present invention is to provide a face to face play area for providing a dual seat activity table for toddlers and babies that allows them to face each other during play.

Lastly, it is an object of the present invention to provide a new and improved face to face play area including a base portion that has a plurality of cylindrical members projecting upwardly therefrom. The cylindrical members are positionable adjacent a corner of the base portion. Included is a top portion that has an upper side, an underside and a pair of circular openings passing therethrough. The upper side has a rectangular play area that is spaced between the circular openings. The underside has a plurality of cylindrical slots, with each slot capable of receiving one of the cylindrical members of the base portion. Each circular opening forms a peripheral ledge along the underside of the top portion. Each ledge has at least four pegs projecting therefrom. Lastly, included are a pair of seat members, with each seat member having a pair of elongated straps. Each strap pair has a disc-shaped cushion positioned within. Each strap has a pair of supporting ends with a pair of keyholes. Each keyhole couples with at least one of the pegs of one of the circular openings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
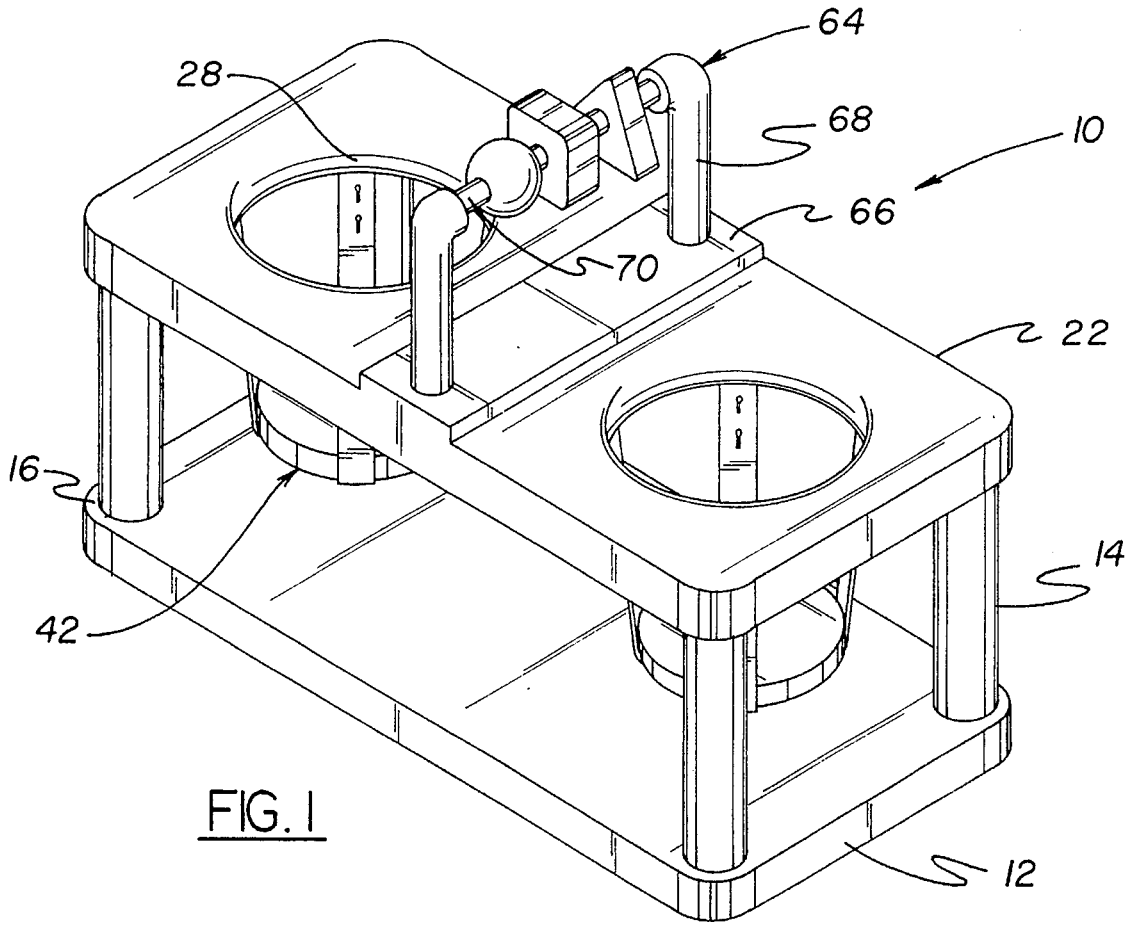
FIG. 1 is a perspective view of the preferred embodiment of the face to face play area constructed in accordance with the principles of the present invention.

With reference now to the drawings, and in particular to FIG. 1 thereof, the preferred embodiment of the new and improved face to face play area embodying the principles and concepts of the present invention and generally designated by the reference numeral 10 will be described.

The present invention, the face to face play area 10 is comprised of a plurality of components. Such components in their broadest context include a base, a top, a pair of seats and a U-frame. Such components are individually configured and correlated with respect to each other so as to attain the desired objective.

Figure 3:
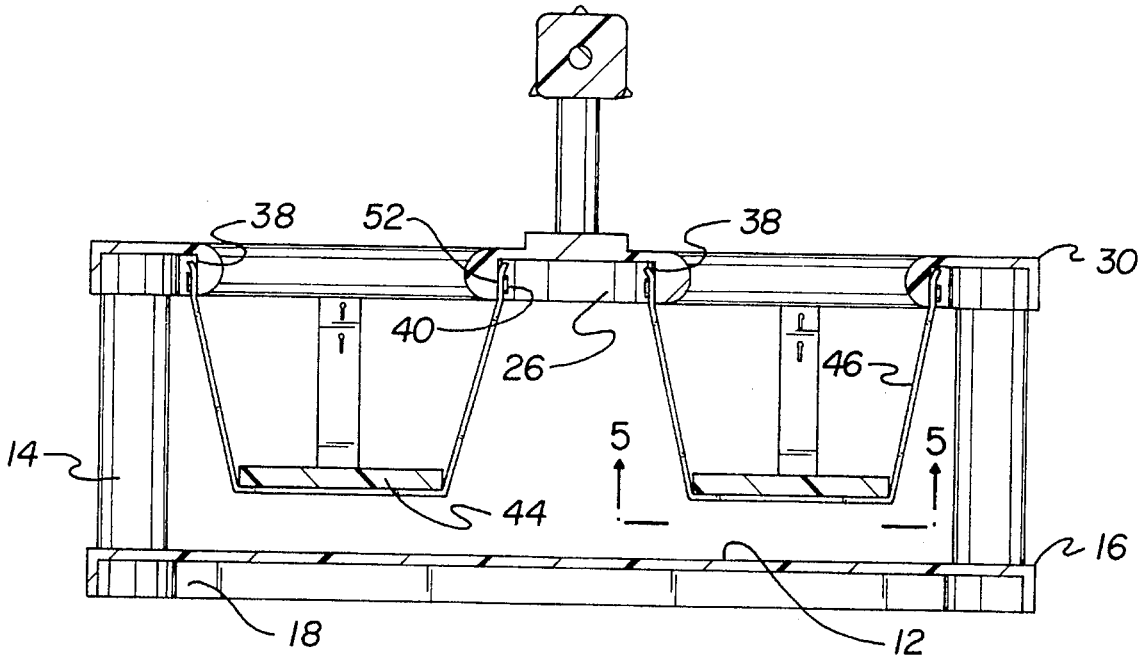
FIG. 3 is cross sectional view of the present invention taken along line 3—3 of FIG. 2.

Specifically, the present invention includes a generally rectangular base portion 12. The base portion is positionable on a receiving surface. The base portion has a plurality of elongated cylindrical members 14 that project upwardly therefrom. As seen in FIG. 1, each cylindrical member is positioned adjacent a corner 16 of the base portion. The base portion is not a solid structure but a hollow structure. Each cylindrical member passes through the base to have one end rest within the hollow 18 of the base portion, as seen in FIG. 3. The base portion has a length of about 5 feet and a width of about 2½ feet. Each cylindrical member has a diameter of about 2 inches and a projecting height of about 15 inches, with the entire length of the cylindrical member being 17 inches.

Figure 2:
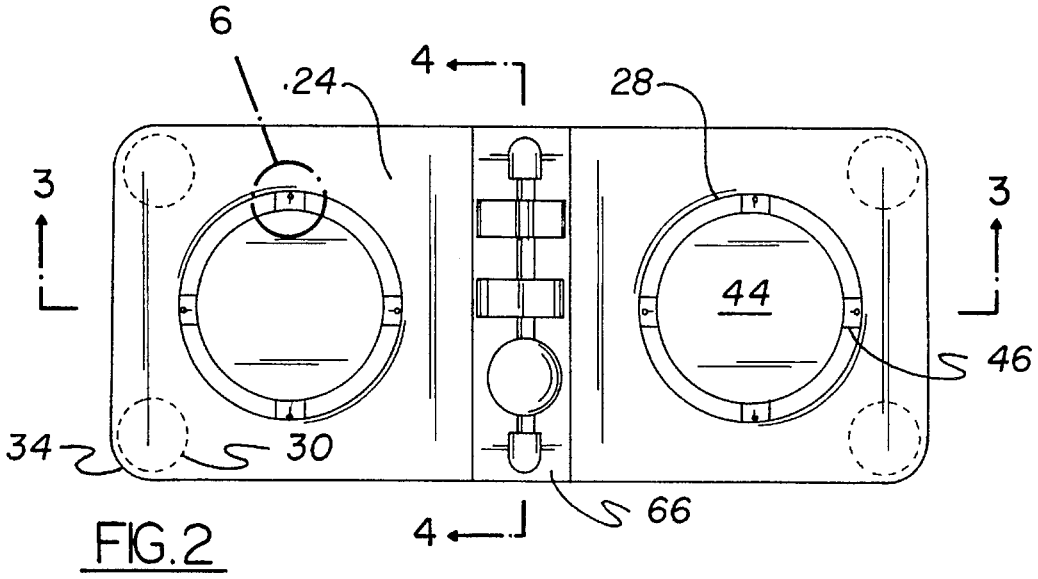
FIG. 2 is a top plan view of the present invention as shown in FIG. 1.

As best illustrated in FIG. 2, a generally rectangular top portion 22 is provided. The top portion has an upper side 24, an underside 26 and a pair of circular openings 28. The underside has a plurality of cylindrical slots 30. Each slot, of FIG. 2, has a diameter of about 2 1/32 inches and a depth of about 1 inch. Each slot is adjacent a corner 34 of the top portion. As seen in FIG. 3, each slot is capable of receiving one of the cylindrical members 14 of the base portion 12. When each slot has each cylindrical member positioned therein, the top portion is positioned above the base portion in a parallel plane. The top portion and the base portion have the same length and width, and have complimentary placement with respect to each other.

Figure 6:
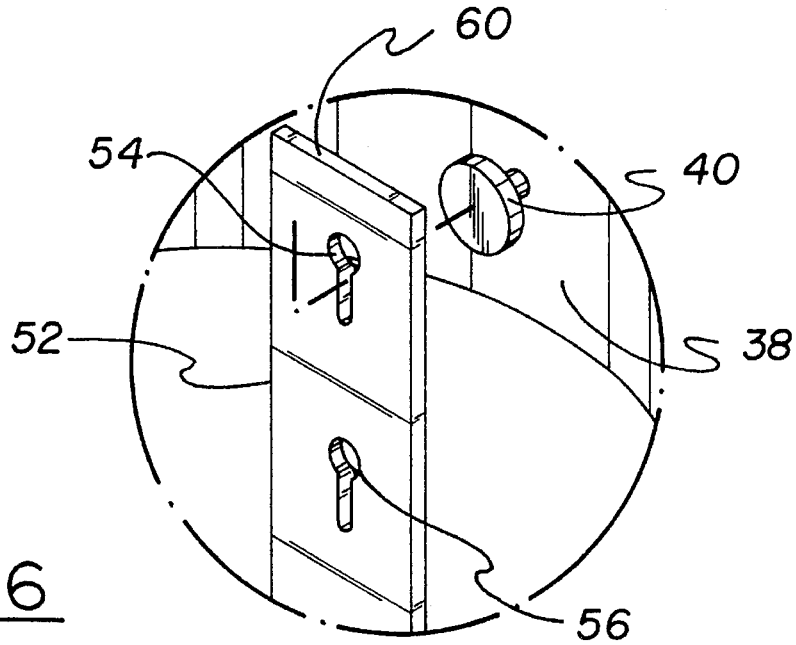
FIG. 6 is a fragmentary enlarged portion of the keyhole and peg taken at position 6 of FIG. 2.

The base portion and the top portion are both formed of a thermal plastic resin. Each portion formed through an injection molding process which eliminates all rough edges that can be harmful to an infant or toddler. Each circular opening 28 has a diameter of about 13 inches. Each circular opening forms a peripheral ledge 38 along the underside of the top portion, as shown in FIG. 3. Each ledge has at least four pegs 40 that are proportionately spaced therearound. Each peg, as seen in FIG. 6, projects perpendicular the ledge.

Figure 5:
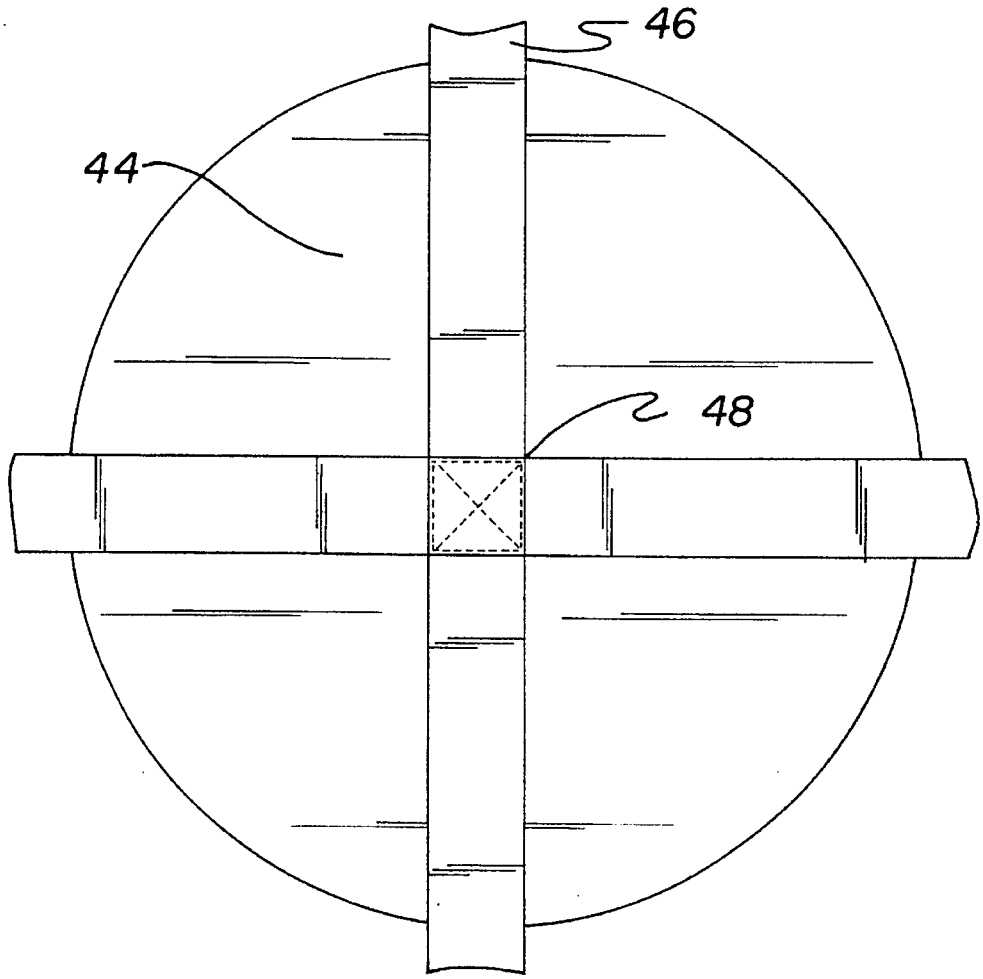
FIG. 5 is a fragmentary bottom view of the seat member of the present invention taken along line 5—5 of FIG. 3.

Also, a pair of seat members 42 are included. Each seat member has a disc-shaped cushion 44 that is supported by a pair of elongated straps 46. Each cushion has a foam interior covered with a soft washable fabric. Each strap is formed of a flexible nylon because of its strength and durability. As illustrated in FIG. 5, each pair of straps have one strap crossed over another strap and stitchedly attached at 48. The distance from position 48 to the end of each strap is identical. Each strap has a pair of supporting ends 52 with a pair of keyholes 54 and 56 that are proportionately spaced one from another. As shown in FIG. 6, one of the keyholes 54 of the keyhole pair is spaced from an edge 60 of each supporting end.

As seen in FIG. 3, each keyhole is capable of coupling with at least one of the pegs 40 of one of the circular openings. Each seat member, when a keyhole of each strap is looped over one of the pegs, is suspended from the circular opening of the top portion. The pair of keyholes allow the height of each seat member to be adjusted up or down. Each seat member, when suspended from the top portion, is capable of supporting a toddler or infant therein. Because the seat has four strap supports, the seat is secure, comfortable and safe.

Figure 4:
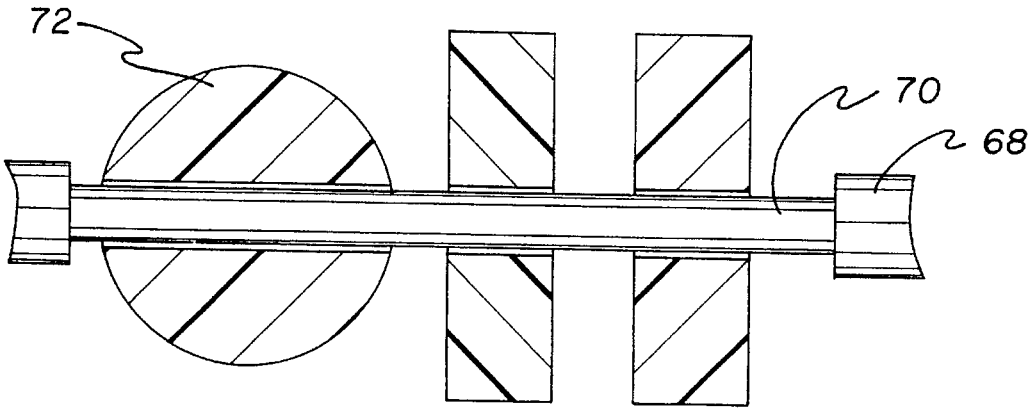
FIG. 4 is a cross sectional view of the U-frame of the present invention taken along line 4—4 of FIG. 2.

Lastly, a U-frame 64 is coupled to a rectangular play area 66 of the upper side of the top portion 22. The play area is raised slightly above the top portion and integral the top portion. The play area is positioned between the circular openings. The U-frame is proportionately spaced from each circular opening and centered on the play area. The U-frame has a pair of truncated side arms 68 joined by a cylindrical rod 70, as seen in FIG. 1. The arms and rod of FIG. 4 are formed of a rigid plastic. The U-frame is capable of rotatably supporting a plurality of play objects 72 above the top portion. As seen in FIG. 1, the objects are geometric shapes. It is to be understood that these objects are not limited too the shapes as shown, but maybe replaced with various other toys.

The present invention is a face-to-face play area for allowing a pair of toddlers to be entertained in a confined space. The present invention is comprised of dual seating that is separated by a generally rectangular play area integral a top portion of the present invention. The base of the present invention is seated on a receiving surface. The top portion of the present invention is placed in complimentary orientation when coupled to the cylindrical member projecting from the base portion. The dual seating of the present invention allows two infants or two toddlers to be each seated in one of the seat members, and in a direction where they face each other. By facing the toddlers or infants toward each other, they are able to entertain each other and use the toys that are supported on the U-frame. The present invention will keep the infant or toddler busy and occupied in a confined and safe location for a reasonable period of time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved face to face play area for allowing a pair of toddlers to be entertained in a confined area comprising in combination:

a generally rectangular base portion being positionable on a receiving surface, the base portion having a plurality of elongated cylindrical members projecting upwardly therefrom, each cylindrical member positionable adjacent a corner of the base portion, the base portion having a length of about 5 feet and a width of about 2½ feet, each cylindrical member having a diameter of about 2 inches and a projecting height of about 15 inches;

a generally rectangular top portion having an upper side, an underside and a pair of circular openings passing therethrough, the underside having a plurality of cylindrical slots, each slot having a diameter of about 2 1/32 inches and a depth of about 1 inch, each slot being adjacent a corner of the top portion, each slot being capable of receiving one of the cylindrical members of the base portion for positioning of the top portion above the base portion in a parallel plane;

each circular opening having a diameter of about 13 inches, each circular opening forming a peripheral ledge along the underside of the top portion, each ledge having at least four pegs proportionately spaced thereon and projecting therefrom;

a pair of seat members with each seat member having a disc-shaped cushion being supported by a pair of elongated straps, each pair of straps having one strap crossed over another strap and stitchedly attached, each strap having a pair of supporting ends with a pair of key holes being proportionately spaced one from another, one of the key holes of the key hole pair being spaced from an edge of each supporting end, each key hole being capable of coupling with at least one of the pegs of one the circular openings, each seat member being capable of being suspended from the top portion when at least one key hole of each strap being coupled to one of the pegs, each seat member being capable of supporting a toddler therein when suspended from the top portion; and a U-frame being coupled to the upper side of the top portion, the U-frame being proportionately spaced from each circular opening, the U-frame being capable of rotatably supporting a plurality of play objects above the top portion.

2. A face to face play area comprising:

a base portion having a plurality of cylindrical members projecting upwardly therefrom and positionable adjacent a corner thereof;

a top portion having an upper side, an underside and a pair of circular openings passing therethrough, the upper side having a rectangular play area being spaced between the circular openings, the underside having a plurality of cylindrical slots with each slot being capable of receiving one of the cylindrical members of the base portion;

each circular opening forming a peripheral ledge along the underside of the top portion, each ledge having at least four pegs projecting therefrom; and a pair of seat members with each seat member having a pair of elongated straps, each strap pair having a disc-shaped cushion being positionable therein, each strap having a pair of supporting ends with a pair of key holes, each key hole being capable of coupling with at least one of the pegs of one the circular openings.

3. The face to face play area as set forth in claim 2 wherein the base portion having a length of about 5 feet and a width of about 2½ feet, and each cylindrical member having a diameter of about 2 inches and a projecting height of about 15 inches.

4. The face to face play area as set forth in claim 2 wherein each slot having a diameter of about 2 1/32 inches and a depth of about 1 inch, and each slot being adjacent a corner of the top portion.

5. The face to face play area as set forth in claim 4 wherein the cylindrical members being positionable within one of the slot members for positioning of the top portion above the base portion in a parallel plane, with the base portion being positionable on a receiving surface.

6. The face to face play area as set forth in claim 2 wherein each circular opening having a diameter of about 13 inches, and the pegs are proportionately spaced along the ledge of each opening.

7. The face to face play area as set forth in claim 2 wherein each pair of straps having one strap crossed one over another strap and being stitchedly attached, the pair of key holes being proportionately spaced one from another linearly along each strap, and one of the key holes of the key hole pair being spaced from an edge of each supporting end.

8. The face to face play area as set forth in claim 7 wherein each seat member being capable of being suspended from the top portion when at least one key hole of each strap being coupled to one of the pegs, each seat member being capable of supporting a toddler therein.

9. The face to face play area as set forth in claim 2 wherein a U-frame being coupled to the play area of the upper side of the top portion, the U-frame being capable of rotatably supporting a plurality of play objects above the top portion.

* * * * *